US006834858B1

(12) United States Patent
Reineke

(10) Patent No.: US 6,834,858 B1
(45) Date of Patent: Dec. 28, 2004

(54) PROJECTILE CATCHING TARGET

(76) Inventor: Dale Reineke, 122 E. Eastman St., Plymoth, WI (US) 53073

( * ) Notice: Subject to any disclaimer, the term of this patent is extended or adjusted under 35 U.S.C. 154(b) by 0 days.

(21) Appl. No.: 10/441,229

(22) Filed: May 20, 2003

(51) Int. Cl.[7] ..... A63B 63/00
(52) U.S. Cl. ..... 273/400
(58) Field of Search ..... 273/398–402, 273/407; 473/170, 172, 195–197, 476, 478, 513, 514; 43/12, 133, 7, 8, 11

(56) References Cited

U.S. PATENT DOCUMENTS

| | | | | | |
|---|---|---|---|---|---|
| 1,668,835 | A | * | 5/1928 | Allen | 43/12 |
| 3,467,388 | A | * | 9/1969 | Weiler | 473/196 |
| 3,579,890 | A | * | 5/1971 | Maxwell | 43/12 |
| D237,808 | S | * | 11/1975 | Edstrand | D21/705 |
| 4,323,251 | A | * | 4/1982 | Loveland et al. | 273/407 |
| 4,826,164 | A | * | 5/1989 | Butcher | 473/456 |
| 5,395,122 | A | | 3/1995 | Kraemer | |
| 5,533,733 | A | | 7/1996 | Dirnbeck | |
| 5,692,979 | A | | 12/1997 | Jones | |
| 5,941,011 | A | * | 8/1999 | Baker | 43/12 |
| 6,389,733 | B1 | * | 5/2002 | Presnell | 43/12 |
| 6,544,132 | B1 | * | 4/2003 | Tvedt | 473/448 |

FOREIGN PATENT DOCUMENTS

WO WO 95/00013 * 1/1995

OTHER PUBLICATIONS

Copy of internet screen offering a Tally–oop Tossing Target.
Copy of an email photograph of the Tally–oop Tossing Target.

* cited by examiner

*Primary Examiner*—Mark S. Graham
(74) *Attorney, Agent, or Firm*—Russell L. Johnson

(57) ABSTRACT

A projectile catching target having: a polygonal tubular frame formed by bending a length of tubular stock so that it forms an opening having a perimeter with angular corners and the ends of the tubular stock meet, a net having an open end and a closed end, and the open end of the net is secured around the frame, a three-way joint having two frame receivers and a leg receiver and the two ends of the tubular stock are engaged with the frame receivers to form a closed frame and the ends of the tubular stock are locked into placed in the three-way joint by friction and the resilience of the tubular frame, and a length of tubular stock is engaged with the leg receiver of the three-way joint to form a low cost target that is readily assembled and disassembled.

8 Claims, 2 Drawing Sheets

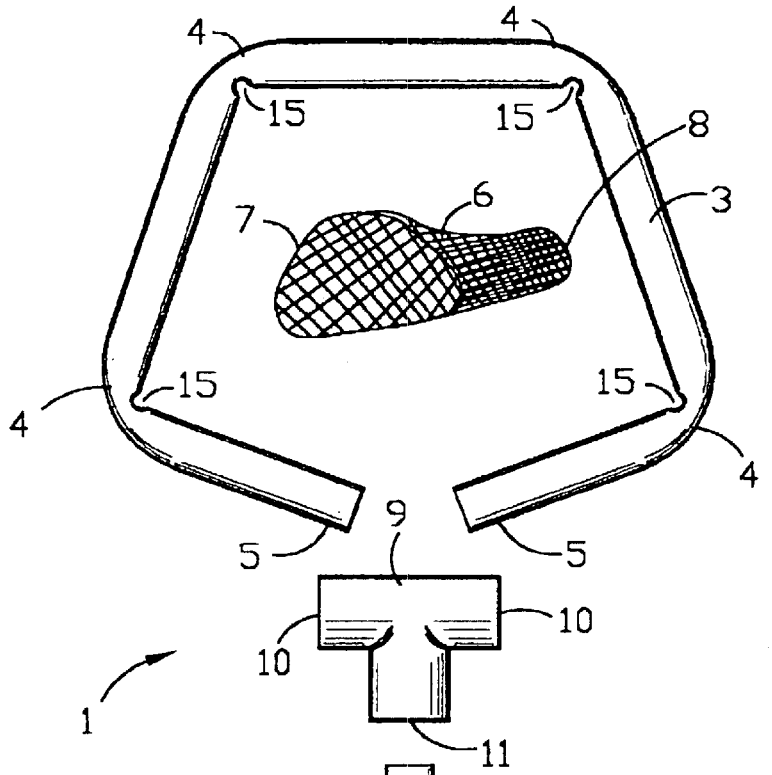
FIG. 1
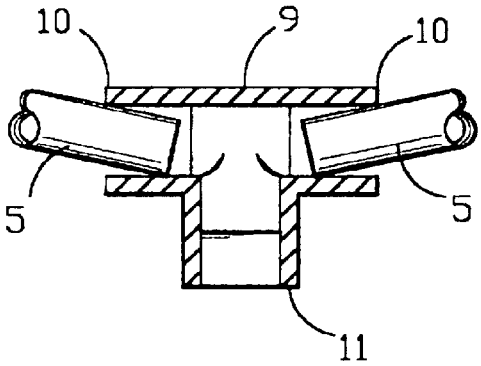
FIG. 2
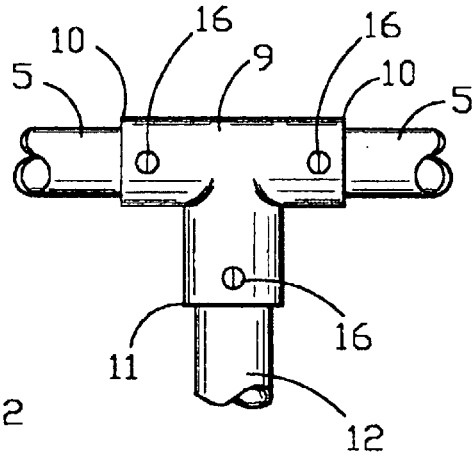
FIG. 3
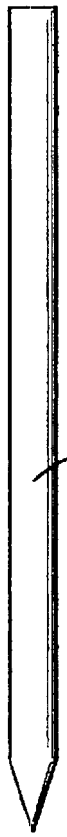

35
24
27
26
22
23
24
35
24
28
35
21
25
25
30
30
29
31
32
41
42
40
10
9
10
5
5
11
17
12

12
18
19

PROJECTILE CATCHING TARGET

BACKGROUND OF THE INVENTION

1. Field of the Invention

This invention relates to targets that catch flying objects that are projected at the target.

More specifically, this invention relates to flying disk targets.

Still more specifically this invention relates to flying disk targets that are particularly well suited to playing "frisbee golf".

2. Description of the Related Art

The art abounds in targets designed to catch flying objects that are thrown or propelled at the targets.

Targets that have a net held open by a frame wherein the flying object is propelled or thrown into the net are used for a diversity of purposes.

Well-known games such as basketball and hockey employ such targets as goals.

Other sports such as golf, football, and baseball employ such targets to capture the object in flight so that the flight of the object is contained in a relatively small area and the flying objects are returned to a collector where they are easily retrieved.

U.S. Pat. No. 5,533,733 to Dinbeck teaches a collapsible and portable frame and net goal wherein the frame is fixed in a configuration by means of pins passing through frame members.

U.S. Pat. No. 5,395,122 to Kraemer teaches a target having a conical net held open by a one-piece circular frame and supported of a upright standard connected to a receiver driven into the ground.

U.S. Pat. No. 5,692,979 to Jones teaches targets having a tubular frame having joints secured by adhesive and supported by a standard.

Prior art devices that have a frame of tubular material and a net for catching flying objects are generally of two types. One type has a rigid frame and rigid supports such as basketball and hockey goals. A second type has collapsible frames and supports. This invention relates to a target or goal of the second type.

Prior art goals are assembled of multiple lengths of tubing and have multiple joints, connected together to form the target. Joints are either threaded or held together by fasteners. These goals require the assembly of a significant number of parts and attaching a net to the frame.

Other prior art assemblies have multiple fixed joints serving in cooperation with hinged joints and assemblies to form a goal that can be quickly set up and taken down but is relatively large and awkward to transport and store.

In counter distinction the basic target of this invention is formed of a single length of tubing bent so that the corners are angular and the ends are joined into a three-way joint where they are locked in place by friction and the three-way joint is mounted on a length of tubing that serves as a standard to complete the target. The target can be set up and taken down without the use of tools and stored compactly so that a multiplicity of such targets can be transported to a site and assembled for use with ease. The target can be adapted for use indoors or outdoors and in or on a number of environments and terrains.

BRIEF DESCRIPTION OF THE INVENTION

The invention in its simplest form is a projectile catching target comprising: a polygonal tubular frame by bending a length of tubular stock so that it forms an opening having a perimeter with angular corners and the ends of the tubular stock meet, a net having an open end and a closed end, and the open end of the net is secured around the frame, a three-way joint having two frame receivers and a leg receiver and the two ends of the tubular stock are engaged with the frame receivers to form a closed frame and the ends of the tubular stock are locked into place in the three-way joint by friction and the resilience of the tubular frame, and a length of tubular stock is engaged with the leg receiver of the three-way joint.

BRIEF DESCRIPTION OF THE DRAWINGS

FIG. 1 is a exploded view of the four components that make up the target of this invention in its simplest form.

FIG. 2 is a partially sectioned view of the three-way joint of this invention showing the cocking of the frame ends to create a bind in the joint.

FIG. 3 is a fragmentary elevation view of the three-way joint of this invention secured by fasteners.

DETAILED DESCRIPTION OF THE INVENTION

Figures 4, 5, 6:
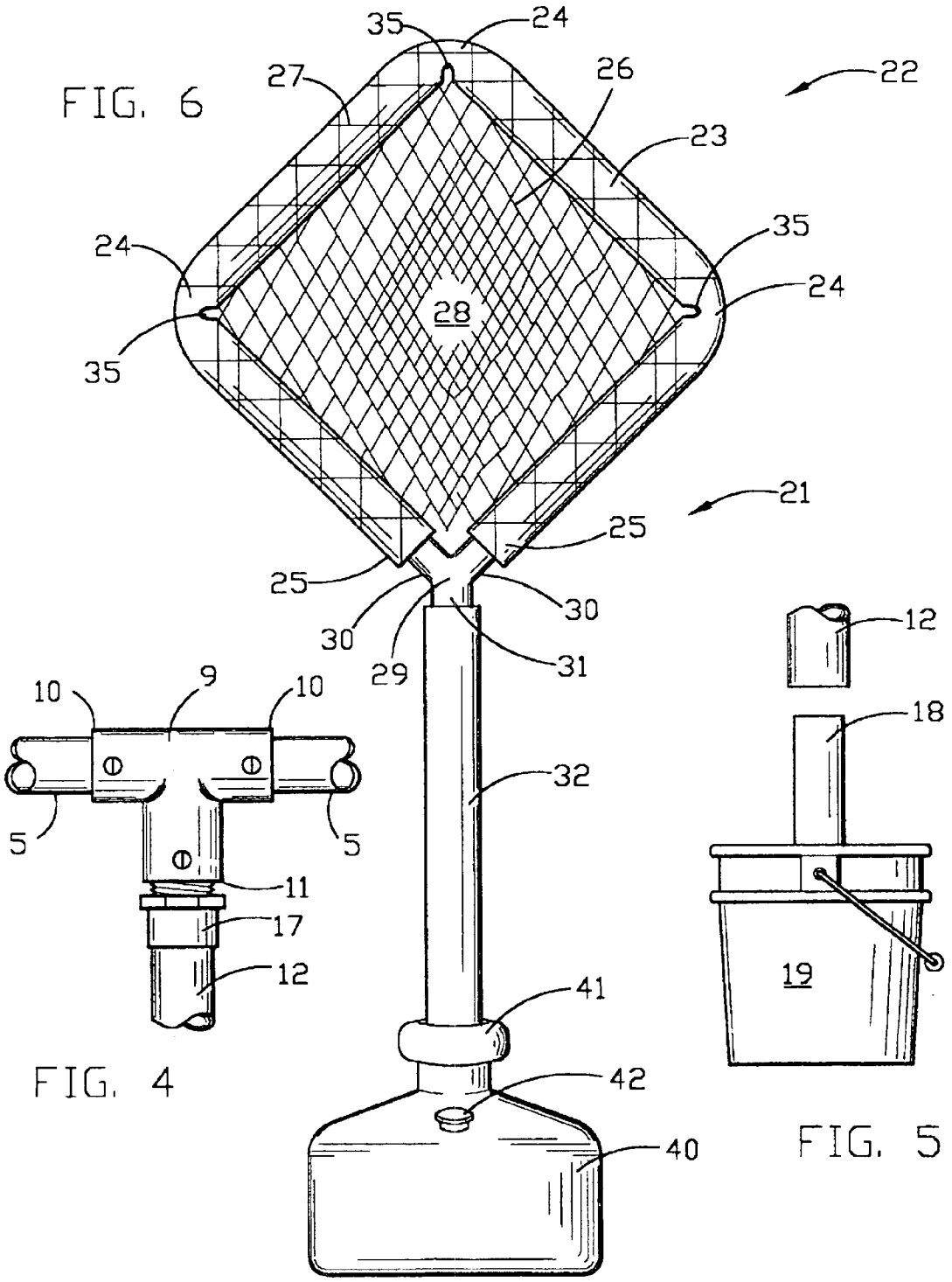
FIG. 4 is a fragmentary elevation view of the three way joint of this invention using a threaded coupling to mount the joint on a standard.
FIG. 5 in an elevation view of the standard of this invention being supported by a stake.
FIG. 6 is a elevation view of a preferred embodiment of the invention.

In the drawings like numbers refer to like objects and the proportions of some aspects of the invention have been modified to facilitate illustration.

Referring now to FIG. 1 wherein the four components of target 1 are shown. A polygonal tubular frame 2, here shown as a rhombus, is formed by bending a length of tubular stock 3 to form an opening having a perimeter with angular corners 4 and wherein ends 5 of tubular stock 3 meet, here shown to meet in the middle of the long side of the rhombus, to form frame 2. Net 6 has an open end 7 and a closed end 8. Net 6 is secured around frame 2 at the open end 7 of net 6. Three-way joint 9, here shown as a T-joint, has two frame receivers 10 and a leg receiver 11. Ends 5 of tubular stock 3 are engaged with frame receivers 10 to form a closed polygonal frame 2. Ends 5 are locked into place in three-way joint 9 by friction and by the resilience of frame 2. A length of tubular stock 12 is engaged with leg receiver 11 of three-way joint 9, to serve as a standard for target 1, to complete the assembly.

The above disclosures are enabling and would permit on skilled in the at to make and use the target of this invention without undue experimentation. To comply with the duty to disclose the best modes of practicing the invention, the following variants and embodiments of the invention are disclosed.

Referring now to FIGS. 1 and 2. Corners 4 of frame 2 are kinked and have notches 15 so that when ends 5 of tubular stock 3 are engaged with frame receivers 10 the sides of frame 2 are resiliently biased outward from the center of frame 2. Three-way joints 9 are fabricated for a close fit with tubular stock 3 so that the cocking of ends 5 in engagement with end receivers 10 of three way joint 9, are added to the frictional fit of tubular stock 3 with joint 9, ends 5 are tightly held in engagement with end receiver 10 and can only be released with the application of considerable force.

When the target is to receive projectiles having high energy such as when the target is used to practice pitching a baseball or as a target for golf balls, it may be desirable to mechanically secure the frame and standard to the three-way joint as shown in FIG. 3. Three-way joint 9 is shown to have ends 5 engaged with frame receivers 10 and tubular stock 12 as a standard engaged with leg receiver 11. Mechanical fasteners 16, here shown as screws, secure frame ends 5 to receivers 10 ad tubular stock 12 to receiver 11. Mechanical fasteners 16 can be pins or clips or any other suitable releasable mechanical fastener.

When frame 2 is to be replaced with a differing frame and the tubular stock 12 that serves as a standard are fixed in place it is desirable that three-way joint 9 be in threaded engagement with tubular stock 12 as shown in FIG. 4. Leg receiver 11 of three-way joint 9 is provided with internal pipe threads and a coupling 17 having external pipe threads is engaged with leg receiver 11 and tubular stock 12 is engaged with the opposite end of coupling 17 and may be secured thereto by means of mechanical fasteners or by bonding.

The portability of the target of this invention is one of the positive attributes of the invention. The ease with which it can be secured in place is complimentary to the target's portability. As shown in FIG. 1, the tubular stock 12 that serves as a standard for target 1 can be sharpened and pushed into the ground directly. As shown in FIG. 5 tubular stock 12 can be slid onto a stake 18 which is driven into the ground or anchored in a container 19.

Referring now to FIG. 6 wherein another preferred embodiment of the invention is shown. Target 21 is shown to have tubular frame 22 and three-way joint 29 having frame receivers 30 engaged with ends 25 of frame 22. Leg receiver 31 is engaged with tubular stock 32, which serves as a standard. Net 26 has a open end 27 and a closed end 28 and open end 27 of net 26 is secured around the perimeter of frame 22. The corners 24 of frame 22 are kinked and have notches 35 which provide a outward resilient bias to the sides of frame 22.

The target of this invention can be fabricated using either metal or plastic tubing. Plastic such as schedule 40 PVC pipe is preferred because the plastic can be heated to flow temperature and bent to form a link and then allowed to cool, thereby providing an angular corner that is strong and resilient.

As shown in FIG. 6, frame 22 is rectangular and ends 25 engage three-way joint 29 at a corner of frame 22. Three-way joint 29 is shown to fit inside tubular stock 23 that makes up frame 22. Tubular stock 32 is shown to be received in a weighted base 40, which is similar to the base used to support umbrellas. Weighted base 40 has a chuck collar 41, which securely engages tubular stock 32 and a fill opening 42 into which eater may be poured to provide the weight required to provide a stable base.

FIG. 6 serves to illustrate that the invention admits of numerous variants without departing from the scope of the invention. Therefore, it should be understood that the scope of the invention should not be limited to the embodiments disclosed, but that the scope of the invention should only be limited by the scope of the appended claims and all equivalents thereto that would be made obvious thereby to one skilled in the art.

What is claimed is:

1. A projectile catching target comprising:

a) a polygonal tubular frame formed by bending a length of tubular stock having two ends so that it forms an opening having angular corners and the ends of the tubular stock meet, b) a net having an open end and a closed end, and the open end of the net is secured around the perimeter of the frame, c) a three-way joint having two frame receivers and a leg receiver and the ends of the tubular stock are engaged with the frame receivers to form a closed frame and the ends of the tubular stock are locked into place with the three-way joint by friction and the resilience of the tubular frame, d) a length of tubular stock which serves as a standard for the target, engaged with the leg receiver of the three-way joint, and e) wherein the corners of the frame are kinked and have notches therein so that the sides of the corners are resiliently urged apart.

2. The target of claim 1 wherein the ends of the frame when engage with the end receivers are cocked relative to the end receivers so that the ends are firmly attached to the receivers by friction and the resilience of the frame.

3. The target of claim 1 wherein the ends of the frame that are engaged with the frame receivers and the tubular stock that engages the leg receiver are secured in place by means of mechanical fasteners.

4. The target of claim 1 wherein the leg receiver of the three-way joint is provided with internal pipe threads and a threaded coupling secured to an end of a length of tubular stock is threadably engaged with the leg receiver.

5. The target of claim 1 wherein the standard is sharpened for insertion into the ground.

6. The target of claim 1 wherein the target is secured in position by sliding the standard over a steak.

7. The target of claim 1 wherein the frame is trapezoidal in shape.

8. The target of claim 1 wherein the frame is rectangular in shape.

* * * * *